US011254482B2

(12) United States Patent
Hunter et al.

(10) Patent No.: US 11,254,482 B2
(45) Date of Patent: Feb. 22, 2022

(54) FILTRATION MASK, PACKAGED FILTRATION MASK, AND TEARABLE CONTAINER

(71) Applicant: Avon Polymer Products Limited, Wiltshire (GB)

(72) Inventors: Nicholas John Hunter, Midsomer (GB); Philip Adam Smith, Trowbridge (GB)

(73) Assignee: Avon Polymer Products Limited, Wiltshire (GB)

( * ) Notice: Subject to any disclaimer, the term of this patent is extended or adjusted under 35 U.S.C. 154(b) by 164 days.

(21) Appl. No.: 16/402,623

(22) Filed: May 3, 2019

(65) Prior Publication Data

US 2019/0337702 A1 Nov. 7, 2019

(30) Foreign Application Priority Data

May 4, 2018 (GB) ..... 1807377

(51) Int. Cl.

| | |
|---|---|
| ***B65D 79/00*** | (2006.01) |
| ***A62B 18/02*** | (2006.01) |
| ***A62B 18/08*** | (2006.01) |
| ***A62B 23/02*** | (2006.01) |
| ***B65D 75/58*** | (2006.01) |
| ***B65D 81/20*** | (2006.01) |

(52) U.S. Cl.

CPC ..... *B65D 79/005* (2013.01); *A62B 18/02* (2013.01); *A62B 18/08* (2013.01); *A62B 23/025* (2013.01); *B65D 75/5805* (2013.01); *B65D 81/2023* (2013.01)

(58) Field of Classification Search

CPC .. B65D 79/005; B65D 75/5805; A61B 18/02; A61B 18/08; A61B 25/025

USPC ..... 128/200.24–201.25; 206/459.1

See application file for complete search history.

(56) References Cited

U.S. PATENT DOCUMENTS

| | | | | |
|---|---|---|---|---|
| 2,814,382 | A * | 11/1957 | Lassiter | B65D 81/2023 53/408 |
| 4,765,498 | A * | 8/1988 | Rafferty | B65D 79/005 215/230 |
| 5,005,700 | A | 4/1991 | Rohling et al. | |
| 5,419,450 | A * | 5/1995 | Guglielmelli | A62B 25/00 128/200.24 |
| 2006/0196157 | A1 | 9/2006 | Greer et al. | |

(Continued)

FOREIGN PATENT DOCUMENTS

| | | | |
|---|---|---|---|
| CN | 203425403 | U | 2/2014 |
| EP | 2630993 | B1 | 11/2018 |

(Continued)

OTHER PUBLICATIONS

Patents Act 1977: Search Report under Section 17(6), 4 pages, dated Apr. 12, 2019, South Wales.

(Continued)

*Primary Examiner* — Chun Hoi Cheung

(74) *Attorney, Agent, or Firm* — McGarry Bair PC

(57) ABSTRACT

A packaged filtration mask comprising a filtration mask packaged in a container in a vacuum or a partial vacuum, wherein the packaged filtration mask comprises an indicator configured to indicate the presence of a vacuum or a partial vacuum in the container, or configured to indicate the lack of a vacuum or a partial vacuum in the container.

20 Claims, 7 Drawing Sheets

(56) References Cited

U.S. PATENT DOCUMENTS

| | | | | |
|---|---|---|---|---|
| 2008/0156329 | A1 | 7/2008 | Gerson et al. | |
| 2010/0218761 | A1* | 9/2010 | Flannigan | B29D 99/0053 128/201.19 |
| 2010/0313338 | A1 | 12/2010 | Resnick | |
| 2011/0126713 | A1 | 6/2011 | Legare et al. | |
| 2011/0247626 | A1 | 10/2011 | Chuang | |
| 2014/0251327 | A1* | 9/2014 | Mittelstadt | A62B 18/10 128/202.22 |
| 2016/0166859 | A1* | 6/2016 | Rachapudi | G01M 3/3263 73/40 |

FOREIGN PATENT DOCUMENTS

| | | | |
|---|---|---|---|
| GB | 573459 | A | 11/1945 |
| GB | 2227472 | A1 | 8/1990 |
| GB | 2419822 | A1 | 5/2006 |
| GB | 2543480 | A | 4/2017 |
| WO | 2005062877 | A2 | 7/2005 |

OTHER PUBLICATIONS

Patents Act 1977: Search Report under Section 17(6), 5 pages, dated Oct. 24, 2018, South Wales.

Adeline Paul, Extended European Search Report, dated Oct. 25, 2019, 10 pages, Munich, Germany.

* cited by examiner

FILTRATION MASK, PACKAGED FILTRATION MASK, AND TEARABLE CONTAINER

CROSS-REFERENCE TO RELATED APPLICATIONS

This patent application claims the benefit of UK patent application no. 1807377.5 filed on 4 May 2018, which is incorporated by reference herein.

FIELD OF THE INVENTION

The present invention relates to a filtration mask, such as an emergency hood, to a packaged filtration mask, and to a tearable container, which for example may be used to contain a filtration mask.

BACKGROUND OF THE INVENTION

Filtration masks are masks that filter ambient gas inhaled into the mask by a person wearing the mask, to produce filtered gas for breathing by the person wearing the mask. A filtration mask can therefore protect the person wearing the mask from inhaling harmful substances in the ambient gas.

Filtration masks are well-known, and in general their configuration depends on their intended use, for example the type(s) of substance that they are intended to filter out, the intended length of time of use, or the environment in which they are intended to be used.

Filtration masks range from simple masks used by e.g. medical professionals that cover only the nose and mouth, to complex filtration masks used by e.g. military personnel that usually have a rubber mask that must effectively seal the face of the wearer.

Intermediate filtration masks include emergency hoods, so-called "escape hoods", which are a type of respirator designed to assist escape from chemical, biological, radiological and nuclear (CBRN) hazards and are not typically intended for prolonged or repeated use. Single-use escape hoods typically need to provide a wearer with protection for a limited time to allow escape from a contaminated area. The escape hood is intended to protect the wearer's respiratory system from hazardous chemicals by filtering out the hazardous chemicals.

Usually, an escape hood of this type has an oro-nasal mask that fits over the wearer's nose and mouth. Filters are connected to the oro-nasal mask. There is a hood portion which extends over the wearer's head. At the bottom of the hood portion there is an elastomeric neck dam which includes an opening through which the wearer puts his head. The hood portion and neck dam are typically connected at a join or seam, created by e.g. a weld.

The filters include a filtration medium, such as activated carbon, that filers ambient gas inhaled into the filtration mask from outside the filtration mask by a person wearing the filtration mask, to produce filtered gas for breathing by the person wearing the mask. In particular, the filtration medium can filter one or more potentially harmful substances from the ambient gas, to protect the person wearing the filtration mask from inhaling the one or more potentially harmful substances.

It is usually desirable that the filtration mask is stored, e.g. in a convenient (smaller) package, before being deployed. During storage the filtration mask is generally folded and vacuum sealed in a vacuum bag, to minimise the size of the filtration mask and to prevent degradation of the materials of the filtration mask caused by ambient gas.

Vacuum packing of the filtration mask is beneficial because otherwise ambient gas containing moisture may come into contact with the filtration mask. Such moisture may be adsorbed by the filtration media in the filter of the filtration mask, for example activated carbon, which will impair the subsequent filtration performance of the filter when the filtration mask is subsequently used. Also, ambient gas that comes into contact with the filtration mask may cause or speed up degradation of one of more of the materials in the filtration mask. For example, ozone damage may be caused to any rubber parts of the filtration mask, such as a rubber neck dam.

The vacuum bag is typically heat welded closed around the filtration mask, to seal the filtration mask in a vacuum or partial vacuum inside the vacuum bag.

When it is necessary for a person to use the filtration mask, they can tear open the vacuum bag and remove the filtration mask from inside the vacuum bag for use.

The present inventors have identified some ways in which filtration masks and/or their storage can be improved. These are discussed below in relation to the different aspects of the present invention.

SUMMARY OF THE INVENTION

As mentioned above, filtration masks are typically stored by being vacuum packed in a vacuum bag. The vacuum or partial vacuum within the vacuum bag protects the filtration mask from contamination and/or degradation caused by ambient gas, as discussed above.

However, the present inventors have realised that during storage it is possible for the vacuum bag to become damaged, so that the vacuum or partial vacuum in the vacuum bag is lost and ambient gas enters the vacuum bag. In such a case, the filtration mask may then need to be replaced, to avoid contamination and/or degradation of the filtration mask having occurred by the time that the filtration mask needs to be used.

The present inventors have further realised that in some cases such damage may be very difficult, or impossible, to spot, such that it is not noticed that the vacuum or partial vacuum in the vacuum bag has been lost until the time that a person needs to use the filtration mask. By this time, the filtration mask may already have been contaminated and/or degraded by the ambient gas, meaning that the user is not properly protected by the filtration mask. For example, a small puncture of the vacuum bag will allow ambient gas into the vacuum bag and may not be easily visible upon visual inspection of the vacuum bag.

At its most general, therefore, a first aspect of the present invention relates to providing a packaged filtration mask with an indicator that indicates the presence of a vacuum or a partial vacuum, or the lack of a vacuum or a partial vacuum, in a container in which the filtration mask is packaged.

Thus, somebody inspecting the packaged filtration mask can easily determine whether or not there is a vacuum or a partial vacuum inside the container, and therefore whether or not the packaged filtration mask needs to be replaced, by inspecting the indicator.

According to a first aspect of the present invention there is provided a packaged filtration mask comprising a filtration mask packaged in a container in a vacuum or a partial vacuum, wherein the packaged filtration mask comprises an indicator configured to indicate the presence of a vacuum or a partial vacuum in the container, or configured to indicate the lack of a vacuum or a partial vacuum in the container.

Thus, somebody inspecting the packaged filtration mask can easily determine whether or not there is a vacuum or a partial vacuum inside the container, and therefore whether or not the packaged filtration mask needs to be replaced, by inspecting the indicator.

The term "partial vacuum" means that the pressure of the gas inside the container has been reduced relative to the ambient gas pressure outside the container, or relative to atmospheric pressure, for example relative to standard atmospheric pressure.

For example, the container may contain a partial vacuum with a pressure in the range of −350 mbar to −650 mbar. In a specific example, the pressure may be −450 mbar.

The term "packaged" means that the filtration mask is contained or stored in the container.

The term "packaged filtration mask" refers to the combination of the container and the filtration mask packaged in the container (in combination with any further containers that may be present). The term "packaged filtration mask" can therefore be replaced with the term "a combination of a container and a filtration mask packaged in the container", where appropriate.

The term "indicator" means any part of the packaged filtration mask, for example any part of the filtration mask and/or container, that is configured to show or identify the presence or lack of a vacuum or partial vacuum inside the container. The "indicator" thereof acts as a vacuum integrity indicator.

The indicator may be one or more of a visible indicator, a tactile indicator or an audible indicator.

The term "indicator" may alternatively be replaced with the term "vacuum integrity sensor", "vacuum integrity identifier", or "vacuum integrity tester".

The indicator can be inspected or investigated from outside the container, for example a state or configuration of the indicator can be determined from outside the container, without needing to open the container.

The container may be any suitable container, for example a vacuum bag.

A filtration mask is an example of a respirator. The term "filtration mask" may alternatively be replaced with the term "respirator", where appropriate.

The packaged filtration mask according to the first aspect of the present invention may optionally have any one, or, where compatible, any combination, of the following optional features.

The indicator may be configured to adopt a first configuration when there is a vacuum or a partial vacuum in the container, and to adopt a second configuration when there is not a vacuum or a partial vacuum in the container.

Thus, somebody inspecting the packaged filtration mask is able to determine the state of (the presence of, or lack of) the vacuum or partial vacuum inside the container by inspecting the configuration of the indicator, specifically whether the indicator is in the first configuration or the second configuration.

The configuration of the indicator can be inspected from outside the container.

When the state of (presence of, or lack of) the vacuum or partial vacuum inside the container changes, the configuration of the indicator will correspondingly change between the first configuration and the second configuration.

Changing between the first configuration and the second configuration may comprise deformation or movement of the indicator.

Thus, somebody inspecting the packaged filtration mask is able to determine the state of (the presence of, or lack of) the vacuum or partial vacuum inside the container by the presence of, or amount of, deformation or movement of the indicator.

Changing from the second configuration to the first configuration may comprise compression/depression of the indicator. Thus, somebody inspecting the packaged filtration mask can identify that there is a vacuum or partial vacuum inside the container by identifying that the indicator is compressed/depressed.

Changing from the first configuration to the second configuration may comprise expansion of the indicator. Thus, somebody inspecting the packaged filtration mask can identify that there is not a vacuum or a partial vacuum inside the container by identifying that the indicator is not compressed/depressed (and thus is expanded relative to the compressed/depressed configuration).

The indicator may be changeable from the second configuration to the first configuration by the application of a force to the indicator.

For example, applying a force to the indicator may cause the indicator to become compressed/depressed or to move, thereby changing from the second configuration to the first configuration.

The container may be a flexible container. For example, the container may be a bag, such as a vacuum bag.

In this context, "flexible" means that the container changes shape when a vacuum or partial vacuum is provided inside the container, specifically that the container contracts, or becomes smaller or collapses.

The term "flexible" may be replaced with the term "deformable", for example the container may be deformable by a vacuum or partial vacuum provided inside the container.

The term "flexible" may alternatively be replaced with the term "collapsible", for example the container may be collapsible by a vacuum or partial vacuum provided inside the container.

The container may have a laminate structure formed by lamination of a number of different layers.

The container may be sealed around the filtration mask by heat sealing the container.

The flexible container may be configured to apply a force to the indicator to change the indicator from the second configuration to the first configuration when there is a vacuum or a partial vacuum inside the flexible container. For example, when the gas inside the flexible container is removed or partially removed by vacuum packing, the difference in pressure between the gas inside the flexible container and the ambient gas outside the flexible container will press the flexible container inwards. The flexible container will therefore apply a force to the filtration mask inside the flexible container, causing the filtration mask to be compressed. This force may be applied to the indicator to cause the indicator to change from the second configuration to the first configuration, for example by causing deformation or movement of the indicator.

In this manner, the presence of the vacuum or partial vacuum inside the container is indicated by the indicator being in the first configuration, for example by being compressed or moved.

The indicator is therefore typically positioned within the container at a position where force is readily transferred from the container to the indicator when there is a vacuum or partial vacuum inside the container.

For example, in the packaged filtration mask the indicator is typically located adjacent to an internal surface of the container, so that force is readily transferred from the internal surface to the indicator when the container reduces in size/collapses due to the vacuum or partial vacuum inside the container.

The indicator is typically configured to change back from the first configuration to the second configuration when the force is not applied to the indicator.

For example, the indicator may be made of resilient material, and/or may be resiliently biased towards the second configuration when it is changed away from the second configuration.

If the vacuum or partial vacuum inside the container is lost by ambient gas entering the container, for example through a puncture of the container, there will no longer be a significant pressure difference between the gas inside the container and the ambient gas outside the container. Therefore, the flexible container will no longer apply the same force to the filtration mask inside the container, and the indicator may therefore change back from the first configuration to the second configuration in the absence of the applied force.

In this manner, the lack of a vacuum or partial vacuum inside the container is indicated by the indicator being in the second configuration, for example by being expanded or moved.

Furthermore, somebody inspecting the packaged filtration mask is able to investigate the state of (presence of, or lack of) the vacuum inside the container by investigating the configuration of the indicator by applying a force to the indicator.

When the indicator is in the first configuration, applying a force to the indicator may have no effect, for example because the indicator is already compressed/depressed or moved by a maximum practical amount. Thus, a person inspecting the packaged filtration mask can determine that there is a vacuum or a partial vacuum in the container by applying a force to the indicator and observing no change in the configuration of the indicator, because this means that the indicator is already in the first configuration.

When the indicator is in the second configuration, applying a force to the indicator will cause the indicator to change to the second configuration, for example by compressing/depressing or moving the indicator. Thus, a person inspecting the packaged filtration mask can determine that there is no vacuum or partial vacuum in the container by applying a force to the indicator and observing a change in the configuration of the indicator, because this means that the indicator is not in the first configuration when the force is applied.

Specifically, the indicator may be changeable from the second configuration to the first configuration when there is not a vacuum or a partial vacuum in the container by applying a force to the indicator, whereas applying the same force to the indicator when the indicator is in the first configuration may have no effect.

The indicator therefore provides a tactile indication to a person inspecting the packaged filtration mask of the state of (presence of, or lack of) the vacuum or partial vacuum inside the container.

The indicator may then return to the second state when the force is removed, allowing repeated confirmation of the lack of vacuum or partial vacuum inside the container.

The indicator may additionally or alternatively make a noise when changing from the second configuration to the first configuration. Thus, the indicator may provide an audible indication that the indicator was not in the first state when the force was applied to the indicator and has changed to the first state due to the applied force. For example, the indicator may make a click noise when changing from the first configuration to the second configuration. A person checking the packaged filtration mask who applies a force to the indicator and hears a click noise therefore knows that there is not a vacuum or partial vacuum inside the container, because the indicator was not in the first configuration when the force was applied.

The indicator may additionally, or alternatively, make a noise when changing from the first configuration to the second configuration, for example when the force applied to the indicator is removed, thereby providing further confirmation of the lack of vacuum or partial vacuum in the container when the person stops applying force to the indicator.

A force greater than a predetermined threshold may need to be applied to the indicator to change the indicator from the second configuration to the first configuration. Thus, a person investigating the state of the indicator may need to press with a force greater than the predetermined force to change the indicator from the second configuration to the first configuration. This may enhance the tactile indication provided by the indicator, because the indicator provides some resistance to pressing before the change from the second configuration to the first configuration.

The indicator may be changeable from the second configuration to the first configuration when there is not a vacuum or a partial vacuum in the container by applying a force to the indicator through the container. Thus, a person inspecting the packaged filtration mask can inspect the state of the vacuum or partial vacuum inside the container by applying the force to the indicator through the container.

As discussed above, typically in the packaged filtration mask the indicator is positioned adjacent to an internal surface of the container. This means that a person inspecting the packaged filtration mask can easily apply force to the indicator by pressing on an external surface of the container opposite to the internal surface of the container.

For example, part of a surface of the container may be in contact with the indicator and may move or deform when the indicator changes between the first state and the second state. Thus, a person inspecting the packaged filtration mask can apply force to the indicator by applying force to the part of the surface of the container that is in contact with the container, and can determine the state of (presence of, or lack of) the vacuum inside the container by inspecting any resultant movement or deformation of the part of the surface of the container, or through the tactile or audible indications discussed above.

The part of the surface of the container in contact with the indicator may be discernible, or marked or indicated on the surface of the container, so that a person inspecting the packaged filtration mask knows where to apply force to the container to best apply force to the indicator to inspect the state of the vacuum or partial vacuum.

Alternatively, a person inspecting the packaged filtration mask may instead be able to determine the state of the indicator, and therefore the state of (presence of, or lack of) the vacuum or partial vacuum inside the container by visually inspecting the part of the surface of the container in contact with the indicator. In such a case, the person inspecting the indicator may not need to apply a force to the indicator.

The packaged filtration mask may comprise a second container in which the container is contained.

The indicator may be capable of being inspected or investigated from outside the second container, for example a state or configuration of the indicator may be capable of being determined from outside the second container, without needing to open the second container.

The indicator may be changeable from the second configuration to the first configuration when there is not a vacuum or a partial vacuum in the container by applying a force to the indicator through the second container and the first container.

For example, the second container may be a protective case, for example a carry case, that is stronger than the container, and which protects the container.

For example, the second container may comprise padding to protect the container.

The second container is typically designed to be easily openable and resealable, and for example may have a zip opener/closer for opening and closing the second container.

A person inspecting the packaged filtration mask may be able to investigate the configuration of the indicator, and therefore the state of (presence of, or lack of) a vacuum or a partial vacuum inside the container by applying force to the indicator through both the second container and the container.

A suitable place to press on the second container so as to apply force to the indicator through both the second container and the container may be discernible, or marked or indicated on the surface of the second container, so that a person inspecting the packaged filtration mask easily knows where to press on the second container.

Therefore, a person inspecting the packaged filtration mask is able to determine the state of (presence of, or lack of) a vacuum or partial vacuum inside the container without removing the container from inside the second container. This may prolong the life of the packaged filtration mask by reducing wear and tear of the container caused by frequently removing the container from the second container for inspection. For example, during such inspection it may be possible to accidentally tear the container, meaning that the packaged filtration mask then needs replacing.

In particular, a person inspecting the packaged filtration mask by pressing on an appropriate part of the second container may experience a tactile and audible indication that the indicator was not in the first configuration when the force was applied, and that therefore there is no vacuum or partial vacuum inside the container.

The indicator may be located within the container such that it is beneath a centre of a main face of the container. Thus, a person inspecting the packaged filtration mask is able to apply force to the indicator conveniently by pressing on the centre of the main face of the container.

Where the second container is present, a person inspecting the packaged filtration mask is also able to apply force to the indicator conveniently by pressing on a centre of a main face of the second container that is positioned above the centre of the main face of the container.

In a specific example, the indicator may comprise a dome switch that is resiliently compressible from a dome shape to a compressed dome shape by application of a force to the dome switch.

The term "dome switch" may instead be replaced with the term "tactile dome component".

The term "dome switch" may merely mean a dome shaped part that is resiliently deformable.

However, typically the dome switch will also provide a switch-like (sudden) transition between two states, such as a compressed and uncompressed state, accompanied by a noise such as a click. This may be achieved by a threshold force being required to compress the dome switch, such that at the moment the force applied to the dome switch becomes greater than the threshold force the dome switch rapidly changes (switches) from the dome shape to the compressed dome shape.

The dome switch may be made of metal, for example steel, such as stainless steel.

The dome switch may be a stainless steel tactile dome component manufactured by Snaptron Inc.®.

The dome switch may be configured to adopt the dome shape when there is not a vacuum or a partial vacuum in the container; and the dome switch may be configured to adopt the compressed dome shape when there is a vacuum or a partial vacuum in the container.

In this example, the second configuration of the dome switch is when the dome switch is in the dome shape. By applying a force to the dome switch, the dome shape can be resiliently compressed to a compressed dome shame, which is the first configuration of the dome switch. A person inspecting the packaged filtration mask can determine that the dome switch is in the second configuration by applying force to the dome switch and determining that deformation of the dome shape has occurred as a result of the applied force. In particular, the person will be able to feel the deformation of the dome shape, therefore providing a tactile indication. Furthermore, deformation of the dome shape to the deformed dome shape may make a noise, for example a click, which provides an audible indication.

When the indicator is in the first configuration, i.e. the compressed dome shape, application of a force to the indicator by a person inspecting the packaged filtration mask may have no effect, such that there is no tactile or audible indication. Therefore, the person inspecting the packaged filtration mask can determine that the dome switch is in the first configuration.

When the filtration mask is packaged in the container and there is a vacuum or partial vacuum inside the container, the container may apply a force to the dome switch that causes the dome switch to adopt the first configuration in which the dome shape is compressed. A person inspecting the packaged filtration mask can therefore determine that there is a vacuum or partial vacuum inside the container by applying a force to the dome switch (for example by applying pressure to a suitable place on the container) and determining that there is no tactile or audible response.

If the vacuum or partial vacuum in the container is lost for any reason, the container may no longer apply the force to the dome switch. Since the dome switch is resiliently compressible, the dome switch will then return from the first configuration to the second configuration in which the dome shape is not compressed. A person inspecting the packaged filtration mask can therefore determine that there is no vacuum or partial vacuum inside the container by applying a force to the dome switch (for example by applying pressure to a suitable place on the container) and determining that there is a tactile or audible response (because the applied force causes the dome shape to compress).

In addition, or alternatively, the change in state of the indicator may cause a visible change in shape of a part of a surface of the container. Therefore, a person inspecting the packaged filtration mask may be able to determine the configuration of the indicator, and therefore the state of (presence of, or lack of) a vacuum or partial vacuum in the container merely by inspecting the shape of the part of the surface of the container, without needing to apply any force to the container or to the indicator.

For example, where the indicator is a dome switch, the part of the surface of the container may change from a dome shape to a compressed dome shape or other shape.

The indicator may be part of the filtration mask.

For example, the indicator may be positioned on an outer surface of the filtration mask.

Typically the indicator is positioned on a surface of the filtration mask that is intended to be on an outer surface of the filtration mask when it is packaged in the container. This is beneficial because it means that it will be easier to apply force to the indicator from an outside of the container, because the indicator will be proximal to an internal surface of the container when the filtration mask is packaged in the container.

The indicator may be on a front face of the filtration mask. When the filtration mask is packaged in the container, the hood portion may be folded beneath the front face of the filtration mask, such that the front face of the filtration mask forms a top surface of the filtration mask when it is packaged in the container, adjacent to an inner surface of a top side of the container. Thus, when the container is collapsed/reduced in size by a vacuum or partial vacuum inside the container, the inner surface of the top side of the container directly applies force to the indicator.

The indicator may protrude from the front face of the filtration mask. This may increase a force applied to the indicator by the container.

The indicator may be positioned in the centre of a filter portion of the filtration mask. Typically the filter portion of the filtration mask is on the front face of the filtration mask.

When the filtration mask is packaged in the container, the filtration mask may be folded beneath the filter portion of the filtration mask. Therefore, by positioning the indicator on the front face of the filtration mask in the centre of the filter portion, the indicator will be in the centre of the top surface of the folded filtration mask. Thus, when the filtration mask is packaged in the container, a force can easily be applied to the indicator by pressing on a centre of a top surface of the container (or a centre of a top surface of the second container where present). This makes it easier and more reliable for a person inspecting the packaged filtration mask to apply a force to the indicator and therefore determine the state of (presence of, or lack of) the vacuum or partial vacuum inside the container.

Furthermore, when a vacuum or partial vacuum is provided inside the container, the indicator will be immediately next to a surface of the container, such that the surface of the container directly applies force to the indicator.

The indicator may be positioned on top of an exhale module of the filtration mask. The exhale module of the filtration mask may be a module that prevents or limits gas being inhaled through the module, but allows gas to be exhaled through the module. In particular, the exhale module may comprise a valve for allowing flow of exhaled gas out of the mask through the valve, but preventing gas from being inhaled into the mask through the valve. Typically the exhale module is provided in the centre of the filter portion on the front face of the filtration mask.

The filtration mask may be an emergency hood, for example a so-called "escape hood".

The filtration mask may comprise an oro-nasal mask that fits over the wearer's nose and mouth.

One or more filters comprising filtration media for filtering gas may be connected to the oro-nasal mask.

The filtration mask may further comprise a hood portion that is configured to extend over the wearer's head.

At the bottom of the hood portion, there may be provided an elastomeric neck dam which includes an opening through which the wearer puts his head.

The container may be a tearable container. "Tearable" means that the container can be torn open by hand, for example without requiring any cutting implements.

Thus, a person requiring the filtration mask can rapidly open the container to remove the filtration mask from the container.

The container may be formed from a laminated material comprising: oriented polyamide; aluminium foil; oriented polyamide; and linear low density polyethylene.

At least a portion of the tearable container may comprise a laminate of a first part and a second part;

a resistance to tearing of the second part may be greater than a resistance to tearing of the first part; and the second part may include a channel portion for directing a tear along the laminate.

The advantages of these features are discussed below, in relation to the third aspect of the present invention.

According to a second aspect of the present invention there is provided a filtration mask comprising an indicator that is configured to adopt a first configuration when the filtration mask is packaged in a container and there is a vacuum or a partial vacuum in the container, and to adopt a second configuration when the filtration mask is packaged in a container and there is not a vacuum or a partial vacuum in the container.

The filtration mask according to the second aspect of the present invention may have any one of, or, where compatible, any combination of, the features of the filtration mask or the indicator discussed above in relation to the first aspect of the present invention. Those optional features of the second aspect of the present invention are not repeated here for conciseness, but are explicitly included in the disclosure of the second aspect of the present invention.

The present inventors have realised that when a person attempts to open a tearable vacuum sealed bag under time pressure, for example in an emergency, the bag can tear unpredictably, for example causing just a corner of the bag to tear off. This leaves the user struggling to open the bag, and can therefore significantly increase the amount of time taken for the user to open the bag and don a filtration mask contained in the bag, for example.

At its most general, therefore, a third aspect of the present invention relates to a tearable container having a tear resistant layer of material in addition to the other layer(s) of the container, wherein the tear resistant layer of material includes a channel to direct a tear of the tearable container.

Thus, the direction of a tear through the tearable container can be precisely controlled using the channel of the tear resistant layer to precisely direct the tear. As such, it can be ensured that a person opening the container can open the container quickly and efficiently, even under time pressure, for example in an emergency.

According to a third aspect of the present invention there is provided a tearable container, wherein:

at least a portion of the tearable container comprises a laminate of a first part and a second part;

a resistance to tearing of the second part is greater than a resistance to tearing of the first part; and the second part includes a channel portion for directing a tear along the laminate.

The third aspect of the present invention may have any one of, or, where compatible, any combination of the following optional features.

The term "channel portion" may mean a portion that is narrow when compared to the width of the second part. Typically, the channel portion is long and thin when compared to the rest of the second part. In other words, the channel portion is elongate.

The channel portion is typically sandwiched between two parts of the second part.

"Tearable" means that the container can be torn open by hand, for example without requiring any cutting implements.

"Resistance to tearing" relates to an amount of force that needs to be applied to tear the part.

The second part may be omitted, or may have a reduced resistance to tearing, in the channel portion. Thus, the channel portion may direct the tear along the laminate by the tear preferentially propagating along the channel portion instead of through the surrounding material of the second part.

"Directing" the tear means guiding the tear, or controlling a direction of propagation of the tear.

A filtration mask may be packaged in the tearable container, for example vacuum packaged in the tearable container.

The container may be a bag, for example a vacuum bag.

The container may be a flexible, deformable or collapsible container.

The first part may be a laminate of a plurality of layers.

For example, the first part may comprise a laminate of:

a first layer of oriented polyamide;

a second layer of aluminium foil;

a third layer of oriented polyamide; and a fourth layer of linear low-density polyethylene.

The second part may be a single layer.

Typically, the channel portion will extend along a line, so as to direct a tear along that line.

The channel portion may extend along a curved line, so that a tear along the laminate is directed along the curved line.

For example, the channel portion may curve around a corner of the tearable container.

The channel portion may extend from a first position proximal to a top side of the container to a second position proximal to a bottom side of the tearable container.

The channel portion may extend along, or adjacent to, a side of the tearable container.

The second part may comprise a layer of high-density polyethylene.

There may be a filtration mask packaged in the tearable container; and the position and length of the channel portion may be configured such that tearing the tearable container along the channel portion opens the tearable container such that the filtration mask can be removed from the container. Thus, the channel portion may guide the tear along the laminate to open the container such that the filtration mask can easily be removed from the container.

Furthermore, an end point of the channel portion proximal to a bottom side of the container may be positioned at a predetermined distance from the bottom side of the container such that when the laminate is torn to the end point of the channel portion, a bottom end of the filtration mask is still supported so that the filtration mask does not fall out of the container during the opening of the container.

In addition, or alternatively, a start point of the channel portion proximal to a top side of the container may be positioned such that when the container is torn open the filtration mask is still partially supported and does not immediately fall out of the container, for example onto the floor.

This may be achieved, for example, by positioning the start point of the channel portion proximal to a mid-point between two sides of the container. For example, the start point of the channel portion may be located at a position between 25% and 75% along a hypothetical perpendicular line connecting the two sides of the container. Thus, when the container is torn open, a corner of the filtration mask may still be supported by a corner of the container at the top part of the container.

For example, in a specific example, the width of the container between the two sides may be approximately 10 cm, and the start point of the channel portion may be located along a hypothetical perpendicular line connecting the two sides of the container at a distance of 5.5 cm from one of the sides. Thus, when the container is torn open, a portion of the container 5.5 cm in length may be left intact at the top side of the container to support the filtration mask. Thus, the filtration mask may be prevented from falling out of the container onto the floor, but can easily be pulled out of the container.

The container may have handles at a top side thereof.

The handles may be for tearing the container open, by a person pulling the handles in opposite directions. A start end of the channel portion may therefore start immediately below the handles, so that the tear through the laminate is directed immediately when/after it is started by the handles.

A whole side (or substantially a whole side) of the container may comprise the laminate of the first part and the second part.

Another part of the container may comprise only the first part and not the second part.

The container may be manufactured by providing the first part, by laminating the second part over a first portion of the first part, by folding a second portion of the first part over the second part laminated on the first portion of the first part, and by then heat welding seams between the second portion of the first part and the second part.

The first portion of the first part and the second portion of the first part may be substantially mirror images of each other along the line at which they are folded.

The container may therefore have two main sides, one of which is comprised of the first part, and one of which is comprised of a laminate of the first part and the second part.

When the filtration mask is positioned in the container, before it is sealed, the filtration mask may be positioned with a filter unit of the filtration mask adjacent to the side which is comprised of the first part, not the side which is comprised of the first part and the second part.

The container in the first aspect of the present invention may optionally have any one, or, where compatible, any combination of the features of the container of the third aspect of the present invention.

According to a fourth aspect of the present invention there may be provided a blank for making a tearable container according to the third aspect of the present invention.

In the packaged filtration mask according to the first aspect of the present invention, or in the filtration mask according to the second aspect of the present invention, the filtration mask may comprise a filter, wherein the filter comprises:

a filtration media for filtering ambient gas to produce filtered gas; and a filtration media support for supporting the filtration media, wherein the filtration media support comprises a filter cover that covers the filtration media and compresses the filtration media;

wherein a main surface of the filter cover facing the filtration media has a non-planar surface.

The advantages of these features are discussed below in relation to the fifth aspect of the present invention.

As discussed above, a typical filtration mask comprises an oro-nasal mask that fits over the wearer's nose and mouth, and one or more filters comprising filtration media for filtering gas connected to the oro-nasal mask.

The filtration media is typically supported by a filtration media support and covered and compressed by a filter cover, which is typically made of metal or thick plastic.

For example, in a known design the filter lid may have a thickness of 2.65 mm when made of plastic.

The filtration cover needs to apply a predetermined amount of compression force on the filtration media to maintain the filtration media in place at a predetermined density.

The present inventors have realised that with a conventional filter cover it is necessary for the filter cover to be made of a strong material, such as metal, or to have a significant thickness, to provide suitable rigidity of the filter cover. Otherwise, when the filter cover is used to provide a necessary amount of compression force on the filtration media, bending or distortion of the filter cover can occur, due to the resultant force on the filter cover acting directly perpendicular to the surface of the filter cover.

At its most general, therefore, a fifth aspect of the present invention relates to a filtration mask wherein a main surface of a filter cover for covering and compressing a filtration media has a non-planar surface (when no force is applied to the filter cover).

The non-planar surface of the filter cover means that the resultant force on the filter cover from compressing the filtration media is not merely all perpendicular to the filter cover, as would be the case with a planar surface, and instead is spread out in more than one direction. This means that a thinner filter cover can be used to apply the necessary amount of compression force on the filtration media without bending or distortion of the filter cover occurring.

According to a fifth aspect of the present invention there is provided a filtration mask comprising a filter, wherein the filter comprises:

a filtration media for filtering ambient gas to produce filtered gas; and a filtration media support for supporting the filtration media, wherein the filtration media support comprises a filter cover that covers the filtration media and compresses the filtration media;

wherein a main surface of the filter cover facing the filtration media is a non-planar surface.

The fifth aspect of the present invention may comprise any one, or, to the extent that they are compatible, any combination of the following optional features.

The main surface may be a non-planar surface when no external force is applied to the filter cover.

"Non-planar" means that a height of the surface perpendicular to the surface varies over the surface.

"Non-planar" means that the surface is not substantially flat.

The main surface of the filter cover may have an undulating surface; or a vaulted surface; or a wavy surface; or a multi-faceted surface.

In cross section, the surface profile may be an oscillating wave.

The undulations, vaults or waves may be in the form of periodically repeating peaks and troughs, or periodically arranged domes or vaults.

The undulations, vaults or waves typically extend out of a plane of the filter cover.

Typically, the undulations, vaults or waves occur in more than one direction over the surface, for example along two perpendicular directions over the surface.

Typically, there are more than two discrete undulations, vaults or waves in any direction along the surface.

An undulating, or vaulted, or wavy surface may mean that the resultant force on the filter cover from compressing the filtration media is spread out and distributed across the filter cover, instead of merely acting perpendicular to the filter cover, because the resultant forces at different locations on the surface of the filter cover are in different directions, instead of all being merely perpendicular to a plane of the filer cover. Thus, bending or deformation of the filter cover may be prevented, and it may be possible to make the filter cover from a less rigid material, and/or to use a thinner filter cover.

For example, the filter cover may be made from plastic, for example injection moulded from plastic.

The filter cover may have a thickness of 2 mm or less.

The filter cover may have a thickness between 1.5 mm to 2.0 mm.

The undulation, vaulting or waves of the main surface of the filter cover may have a fixed period. In other words, the undulation, vaulting, or waves may be regular, instead of irregular or random.

The undulations, vaults or waves essentially reinforce the surface of the filter cover.

The filter cover typically includes holes for allowing gas to enter the filter. These holes may be arranged in a tessellation pattern.

The holes may be arranged in a hexagonal honeycomb pattern.

The filtration media may comprise activated carbon.

In a specific example, a height of the undulations, waves or vaults in the surface may be 0.9 mm. In other examples, the height may be in the range of 0.5 mm to 1.5 mm.

In a specific example, a distance between peaks/maximum heights of the undulations, waves or vaults in the surface may be 18 mm. In other examples, the distance may be in the range of 10 to 25 mm.

The holes in the filter medium may have a diameter of 5 mm. In other examples, the diameter may be between 2 and 8 mm.

Although the aspects of the present invention have been discussed separately above, any combination of the aspects of the present invention, where compatible, may be present at the same time in a single embodiment of the present invention.

BRIEF DESCRIPTION OF THE DRAWINGS

Embodiments of the present invention will now be discussed, by way of example only, with reference to the accompanying Figures, in which:

FIG. 3(*b*) is an enlarged view of the indicator shown in FIG. 3(*a*);

DETAILED DESCRIPTION OF THE PREFERRED EMBODIMENTS AND FURTHER OPTIONAL FEATURES OF THE INVENTION

Embodiments of the present invention will now be discussed with reference to FIGS. 1 to 11.

Figure 1:
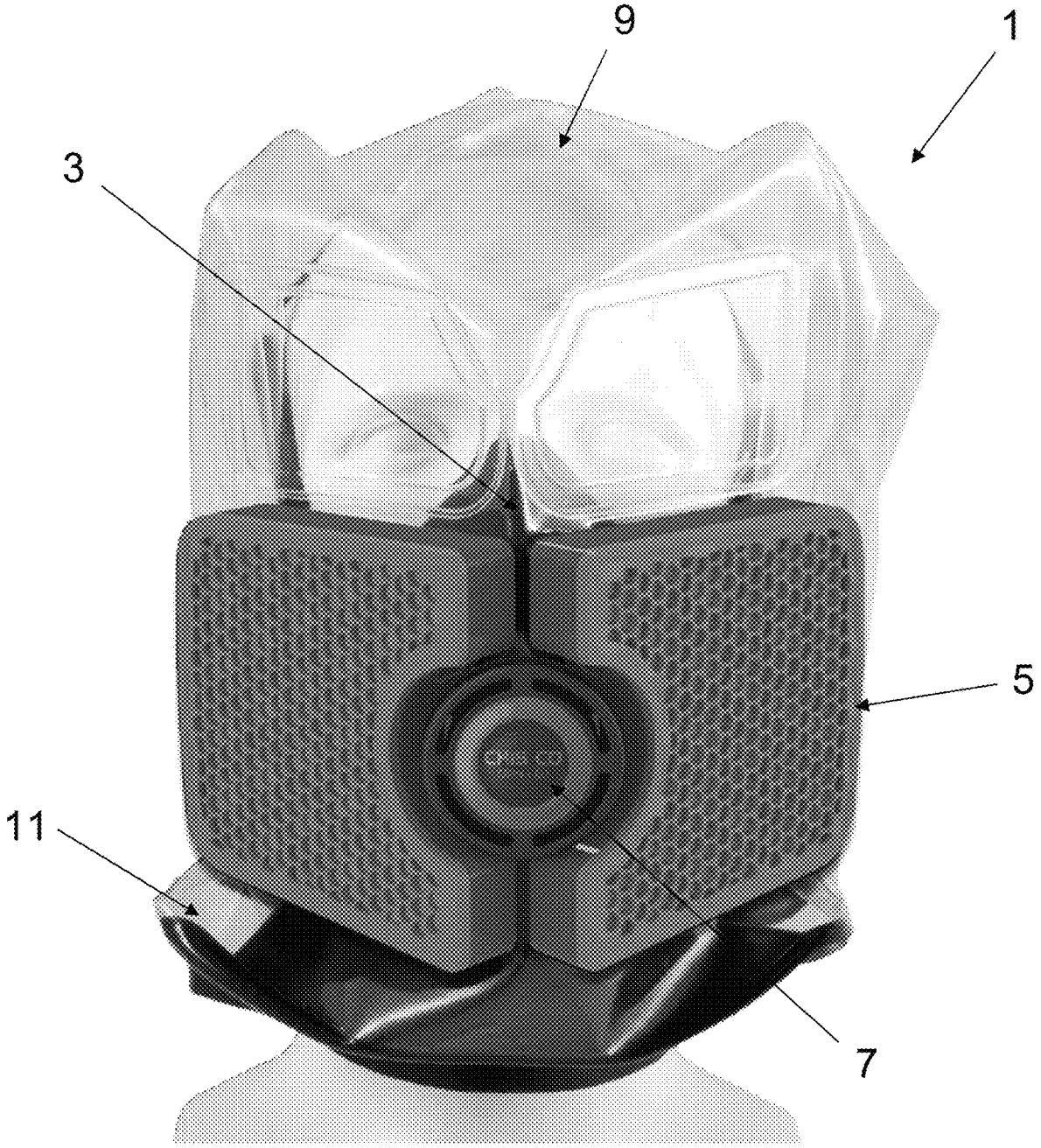
FIG. 1 shows a filtration mask according to an embodiment of the present invention.

FIG. 1 shows a filtration mask 1 according to an embodiment of the present invention.

As shown in FIG. 1, the filtration mask 1 is an emergency hood (an "escape hood").

The filtration mask 1 comprises an oro-nasal mask 3 that fits over the wearer's nose and mouth.

Two filters 5 are connected to the oro-nasal mask 3.

An exhale unit 7 is positioned centrally on a front surface of the filtration mask 1 between the two filters 5. The exhale unit 7 includes an indicator for indicating the presence of, or lack of, a vacuum or a partial vacuum in a container in which the filtration mask is packaged, which is discussed in detail below.

The filtration mask 1 further comprises a hood portion 9 which is configured to extend over the wearer's head.

At the bottom of the hood portion 9 there is an elastomeric neck dam 11 which includes an opening through which the wearer puts his head. The hood portion 9 and neck dam 11 are typically connected at a join or seam, created by e.g. a weld.

The filters 5 are in fluid communication with the oro-nasal mask 3, so that when wearer of the mask inhales, the reduction in pressure inside the oro-nasal mask 3 causes ambient gas to be sucked into the oro-nasal mask 3 through the filters 5.

The filters 5 include a filtration medium, such as activated carbon, which can filter one or more substances from the inhaled ambient gas, so as to provide filtered gas that does not include the one or more substances (or that includes reduced amounts of the one or more substances) for breathing by the wearer of the mask.

The structure of the filters 5 is discussed in more detail below.

Figure 2:
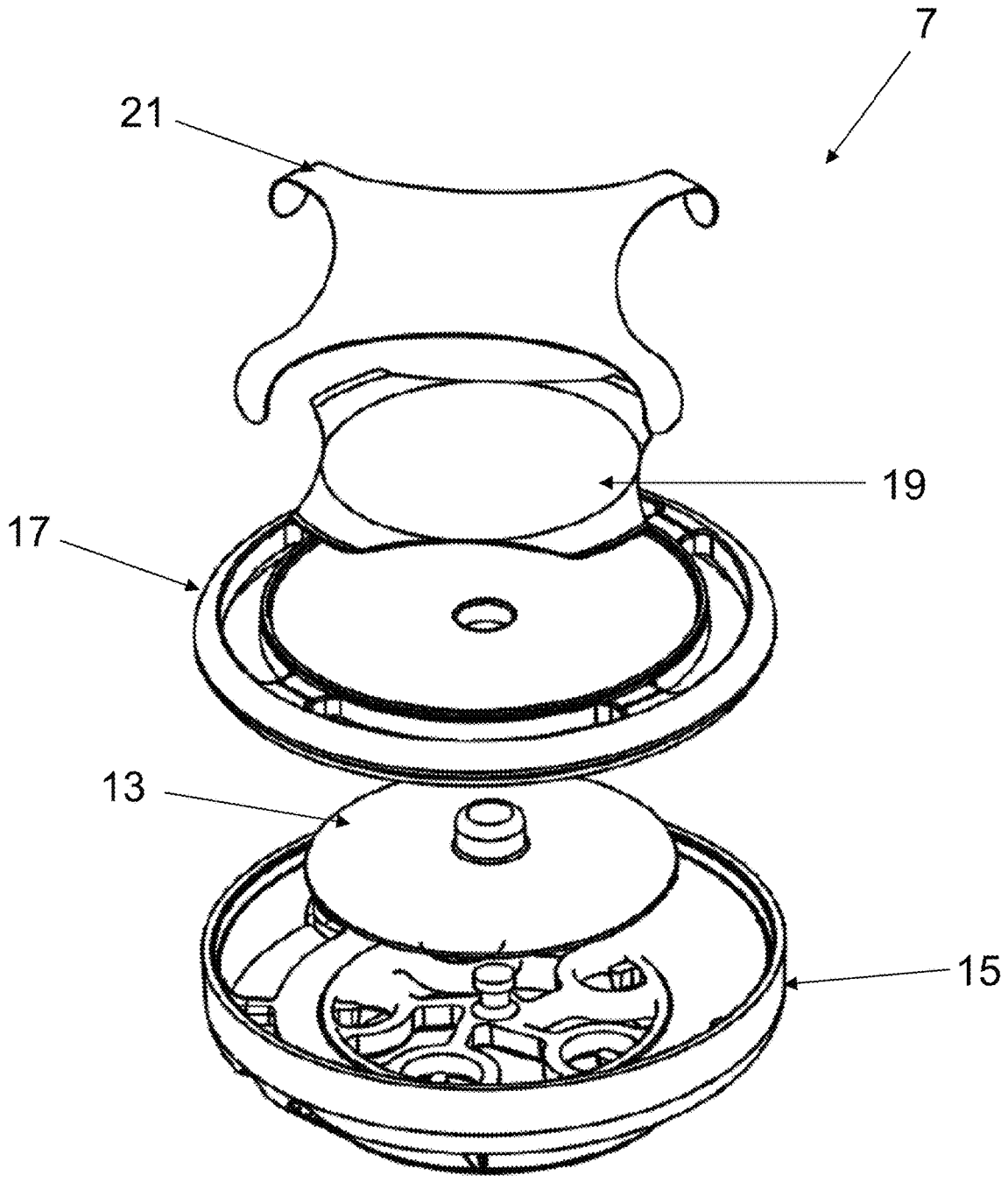
FIG. 2 is an exploded view of an exhale module of an embodiment of the present invention, including an indicator of an embodiment of the present invention.
Figure 3A:
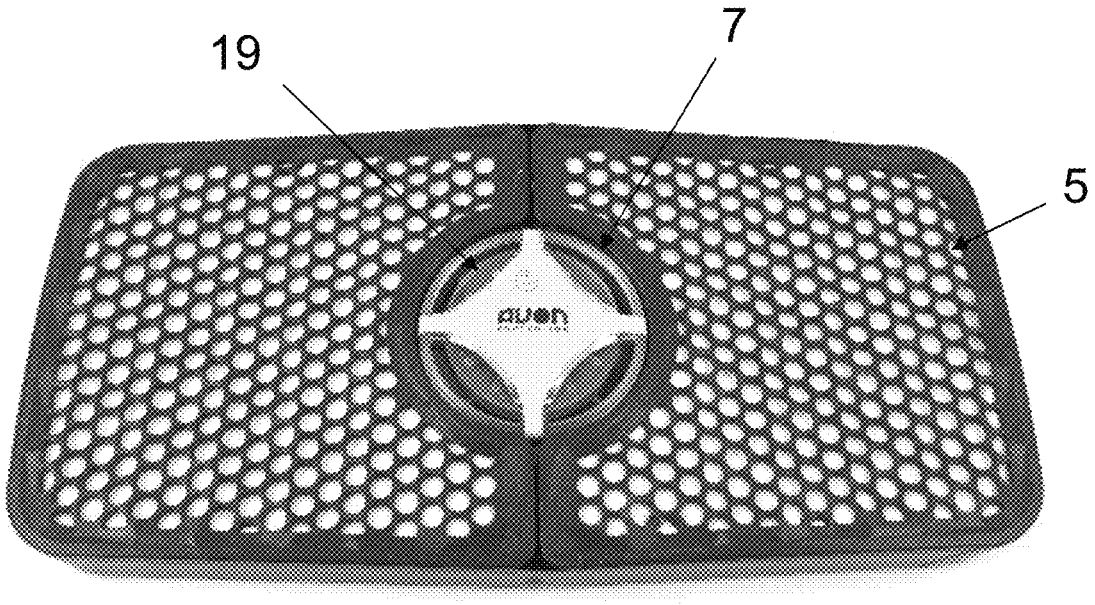
FIG. 3(*a*) shows a filter element of a filtration mask according to an embodiment the present invention, showing a position of the indicator on the filtration mask.
Figure 3B:
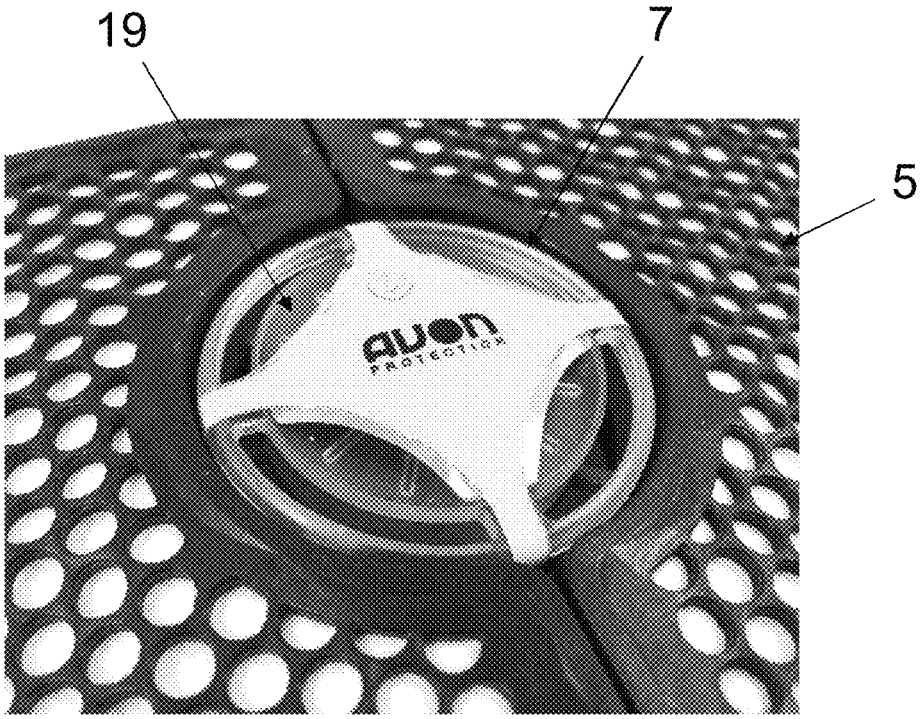

The structure of the exhale unit 7 is shown in more detail in FIG. 2, and the positioning of the exhale unit 7 on the filtration mask 1 is shown in further detail in FIGS. 3(*a*) and 3(*b*).

The exhale unit 7 allows gas exhaled into the filtration mask 1 to be discharged to outside the filtration mask 1, but prevents ambient gas from being inhaled into the filtration mask 1 through the exhale unit 7.

Specifically, the exhale unit 7 includes a valve 13 that allows flow of gas in a direction from the inside of the filtration mask 1 to the outside of the filtration mask 1 (upwards in FIG. 2), and that prevents flow of gas in a direction from the outside of the filtration mask 1 to the inside of the filtration mask 1 (downwards in FIG. 2).

The exhale unit 7 further comprises an exhale module body 15 and an exhale module cover 17, which together enclose the valve 13.

The exhale module body 15 is connected to, or is integral with, a main body of the filtration mask 1, and/or the filters 5.

Furthermore, the exhale unit 7 includes a tactile dome component 19, which forms the indicator of an embodiment of the present invention. The tactile dome component 19 is positioned on top of the exhale module cover 17.

Finally, the exhale unit 7 may include an optional sticker 21 positioned on top of the tactile dome component 19.

The tactile dome component 19 in this embodiment is a stainless steel component, which in a specific example may be a stainless steel tactile dome component manufactured by Snaptron Inc.

In a rest state ("a second configuration"), the tactile dome component 19 substantially has a dome shape.

When a force greater than a predetermined threshold is applied to the tactile dome component 19 from above (from the top in FIG. 2), the dome shape of the tactile dome component 19 is compressed/depressed to a compressed/depressed dome shape ("a first configuration"—not shown). In other words, the peak of the dome shape is pressed downwards.

Once the threshold force is exceeded, the shape of the tactile dome component 19 rapidly changes from the dome shape to the compressed/depressed dome shape, providing tactile feedback to a person applying the force to the tactile dome component 19.

Furthermore, the tactile dome component 19 makes an audible sound, specifically a click sound, when changing from the dome shape to the compressed dome shape, or when changing from the compressed dome shape to the dome shape, providing audible feedback to a person applying the force to the tactile dome component 19.

The tactile dome component 19 is resilient, such that when the force applied to the tactile dome component 19 is removed, the tactile dome component 19 rapidly changes from the compressed/depressed dome shape to the dome shape.

As shown in FIGS. 1, 3(*a*) and 3(*b*), the exhale unit 7 is positioned centrally on a front fact of the filtration mask 1 between the two filters 5.

The tactile dome component 19 is positioned on top of the exhale unit 7, and is therefore easily accessible on the front face of the filtration mask 1.

Furthermore, the tactile dome component 19 protrudes from the front face of the filtration mask 1.

For storage before use, the filtration mask 1 is vacuum sealed in a vacuum bag (a container), to protect the filtration mask 1 from contamination and/or degradation caused by ambient gas.

Specifically, the filtration mask 1 is packaged inside a vacuum bag with the hood portion etc. folded beneath the filters 5 and the exhale unit 7. The filters 5 and exhale unit 7 therefore form an upper surface of the filtration mask 1 packaged in the vacuum bag.

When a vacuum or partial vacuum is formed inside the vacuum bag, the vacuum bag is collapsed around the filtration mask 1 and applies pressure to the filtration mask 1.

Since the tactile dome component 19 is positioned on top of the exhale unit 7 on the upper surface of the filtration mask 1 packaged in the vacuum bag, the tactile dome component 19 is adjacent to an inner surface of the vacuum bag. Therefore, when the vacuum bag is collapsed around the filtration mask 1, the inner surface of the vacuum bag applies pressure to the tactile dome component 19. This pressure is sufficient to compress/depress the tactile dome component 19 into the compressed/depressed dome shape ("the first configuration"), and to hold the tactile dome component 19 in this configuration. If a person inspecting the packaged filtration mask subsequently applies a further force to the tactile dome component 19 through the vacuum bag, there will be substantially no response, because the tactile dome component 19 is already compressed/depressed by the vacuum or partial vacuum in the vacuum bag, and therefore the person will not experience any tactile or audible feedback.

As such, a person inspecting the packaged filtration mask is able to determine that there is a vacuum or a partial vacuum inside the vacuum bag by pressing on the tactile dome component 19 through the vacuum bag and not experiencing any tactile or audible feedback. The tactile dome component therefore acts to indicate a state of (presence of, or lack of) a vacuum or partial vacuum inside the vacuum bag.

The fact that the exhale unit 7 and therefore the tactile dome component 19 are in the centre of the filter units 5 means that a person inspecting the packaged filtration mask can press on the tactile dome component 19 by pressing on a centre of a main surface of the vacuum bag, which is convenient.

If the vacuum bag is breached for any reason, such that ambient gas enters the vacuum bag, the vacuum or partial vacuum inside the vacuum bag will be lost as ambient gas enters the vacuum bag. Since there will then no longer be a significant pressure difference between the gas in the vacuum bag and the ambient gas, the vacuum bag will no longer provide any significant force on the tactile dome component 19. The resilience of the tactile dome component 19 means that it will then automatically return to the dome shape ("the second configuration") from the compressed/depressed dome shape ("the first configuration").

Figure 4:
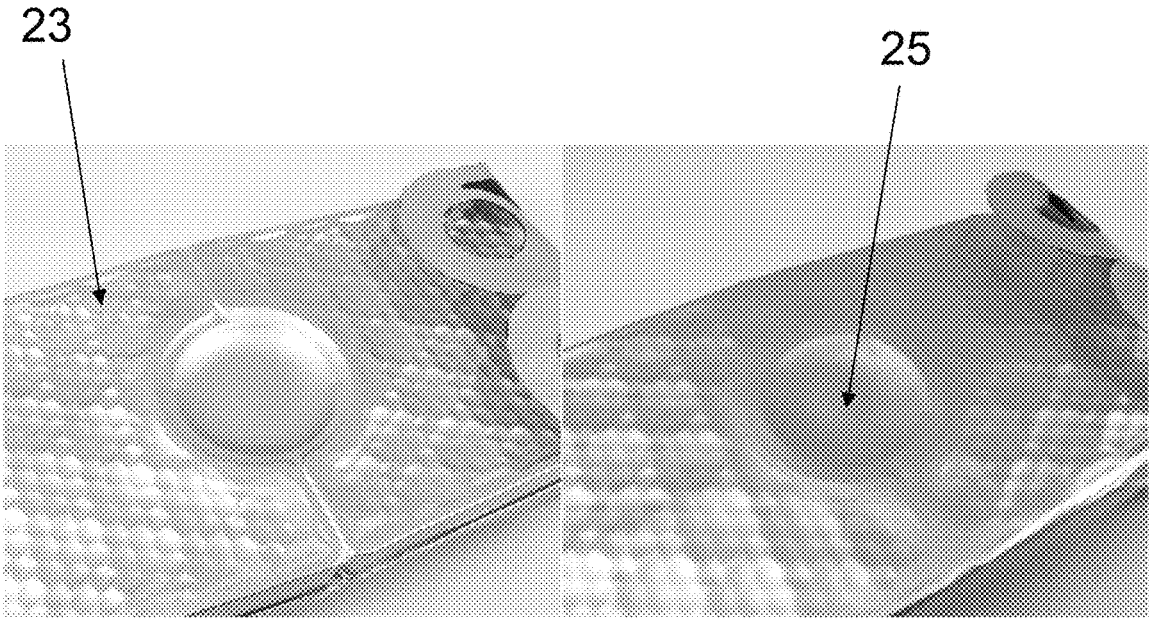
FIG. 4 shows two views of a packaged filtration mask according to an embodiment of the present invention. In the left view, the indicator is in the first configuration indicating a vacuum or partial vacuum in the container. In the right view, the indicator is in the second configuration indicating a lack of a vacuum or partial vacuum in the container.

As shown in FIG. 4, this change in configuration of the tactile dome component may be visible on a surface of the vacuum bag.

The left hand image in FIG. 4 shows the filtration mask 1 packaged in a vacuum bag 23 with a vacuum or partial vacuum inside the vacuum bag 23.

The filtration mask 1 is packaged in the vacuum bag 23 with the front face of the filtration mask 1, comprising the exhale unit 7 and the two filters 5, on a top surface of the filtration mask, beneath the main surface of the vacuum bag 23 illustrated in FIG. 4. Thus, the tactile dome component 19 is positioned immediately beneath a centre of the main surface of the vacuum bag 23, in contact with the main surface of the vacuum bag 23. As such, when the tactile dome component 19 changes from the compressed/depressed dome shape to the dome shape when a vacuum or partial vacuum inside the vacuum bag 23 is lost, a corresponding change in shape is caused in the main surface of the vacuum bag 23 over the tactile dome component 19, and this change in shape can be seen on the vacuum bag 23.

Specifically, the right hand image in FIG. 4 shows the shape of the main surface of the vacuum bag 23 when the tactile dome component 19 has returned to the dome shape. In particular, the shape of an area 25 of the main surface of the vacuum bag 23 immediately over the tactile dome component 19 changes when the configuration of the tactile dome component 19 changes.

When there is no vacuum or partial vacuum inside the vacuum bag, the tactile dome component 19 has the uncompressed dome shape. If a person inspecting the packaged filtration mask applies a force to the tactile dome component 19 through the vacuum bag that is greater than the threshold force required to compress/depress the tactile dome component 19, the tactile dome component 19 will then be compressed/depressed to the compressed/depressed shape. The person pressing on the tactile dome component 19 will therefore experience a tactile feedback indicating that the tactile dome component was in the dome shape when they pressed on it. Furthermore, they will also experience an audible feedback, due to the click noise made then the tactile dome component 19 is compressed/depressed.

When the person then removes the force on the tactile dome component 19, the tactile dome component 19 will then return to the uncompressed dome shape, accompanied by a further audible feedback.

The person applies the force to the tactile dome component 19 by applying pressure to the vacuum bag in an area over the tactile dome component 19.

As such, a person inspecting the packaged filtration mask is able to determine that there is no vacuum or partial vacuum inside the vacuum bag by pressing on the tactile dome component 19 through the vacuum bag and experiencing a tactile or audible feedback.

Therefore, the person inspecting the packaged filtration mask is able to accurately determine the state of (presence of, or lack of) the vacuum or partial vacuum inside the vacuum bag merely by pressing on part of (typically the centre of a main face of) the vacuum bag.

Figure 5:
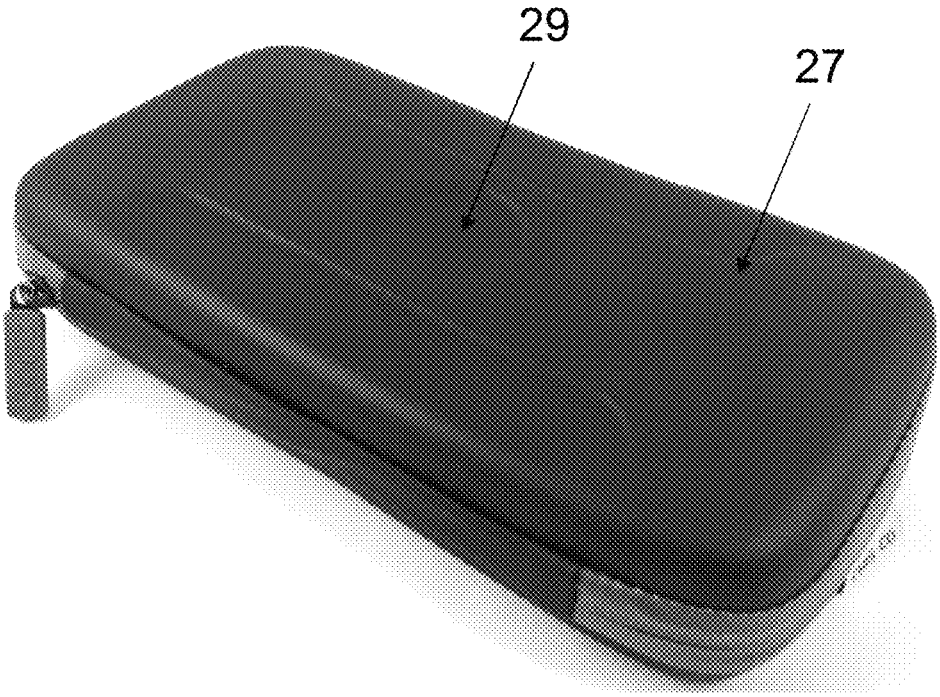
FIG. 5 shows a carry case (a second container) of an embodiment of the present invention.

As shown in FIG. 5, the vacuum bag may be contained within a further protective case 27. For example, the protective case 27 may be made of a stronger or tougher material than the vacuum bag, and may for example be provided with padding. The protective case 27 protects the vacuum bag from being damaged during storage, for example by preventing perforation of the vacuum bag.

Figure 6:
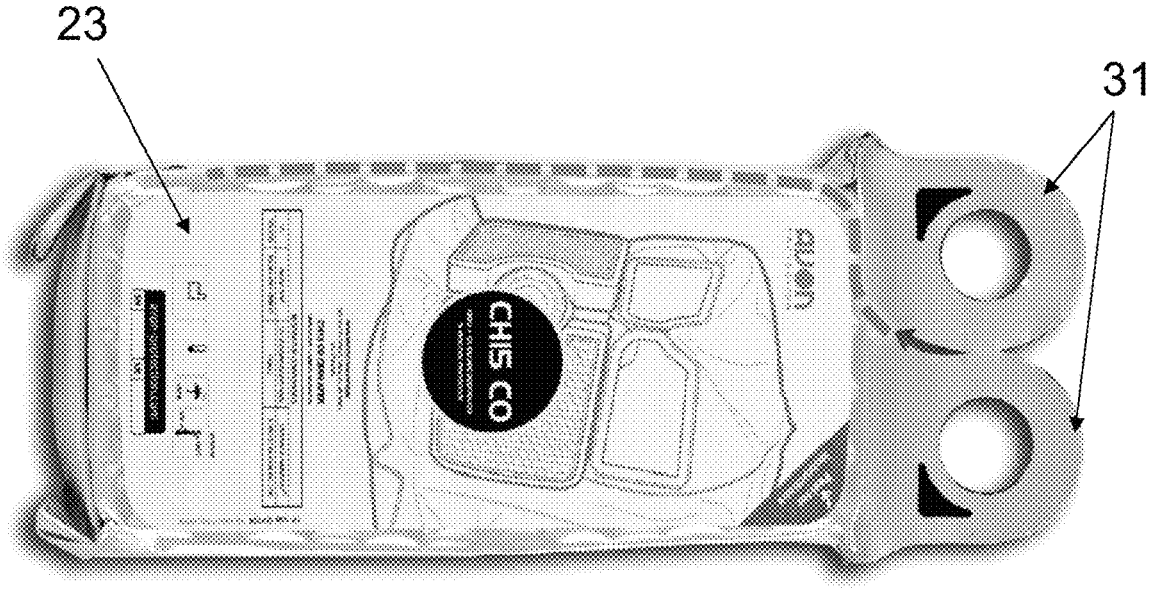
FIG. 6 shows a tearable container of an embodiment of the present invention, with the path of the channel portion indicated using a broken line.

As shown in FIG. 6, the protective case 27 may include a marking or indication 29, in this case in the form of a recessed circle portion, on its surface indicating the position of the tactile dome component 19 within the vacuum bag within the protective case 27. For example, where the tactile dome component 19 is positioned beneath a centre of a main face of the vacuum bag, the marking or indication 29 of the protective case 27 is in a centre of a main face of the protective case 27.

The protective case 27 is flexible/deformable, such that a person inspecting the packaged filtration mask can apply pressure to the marking or indication 29 of the protective case 27 so as to apply pressure to the tactile dome component 19 through the vacuum bag. The person can experience any resulting tactile or audible feedback through the protective case 27.

Therefore, the person inspecting the packaged filtration mask can inspect the state of (presence of, or lack of) the vacuum inside the vacuum bag without needing to remove the vacuum bag from the protective case 27, which will prolong the life of the packaged filtration mask through reduced wear and tear on the vacuum bag that would otherwise be caused by the need to regularly remove the vacuum bag from the protective case 27 for inspection.

FIG. 6 shows a further view of a packaged filtration mask of an embodiment of the present invention. As discussed above, the filtration mask 1 is packaged in a vacuum bag 23 with a vacuum or partial vacuum inside.

As shown in FIG. 6, the vacuum bag 23 comprises two handles 31 at an upper end of the vacuum bag 23. The handles 31 are to facilitate tearing open of the vacuum bag 23, so that the filtration mask 1 can be removed from the vacuum bag 23.

Specifically, a person opening the vacuum bag 23 can do so by pulling the handles 31 in opposite directions (into and out of the page in FIG. 6), so as to tear the vacuum bag 23 between the two handles 31.

In a conventional vacuum bag, tearing open the vacuum bag, particularly in a hurry in an emergency, can result in unpredictable tearing of the vacuum bag. For example, it is possible for just a corner of the vacuum bag to tear off, leaving the user struggling to open the vacuum bag sufficiently to remove the filtration mask from the vacuum bag.

In an embodiment of the present invention, an additional tear resistant layer that includes a channel to guide a tear of the vacuum bag 23 is included in the vacuum bag 23.

Figure 7:
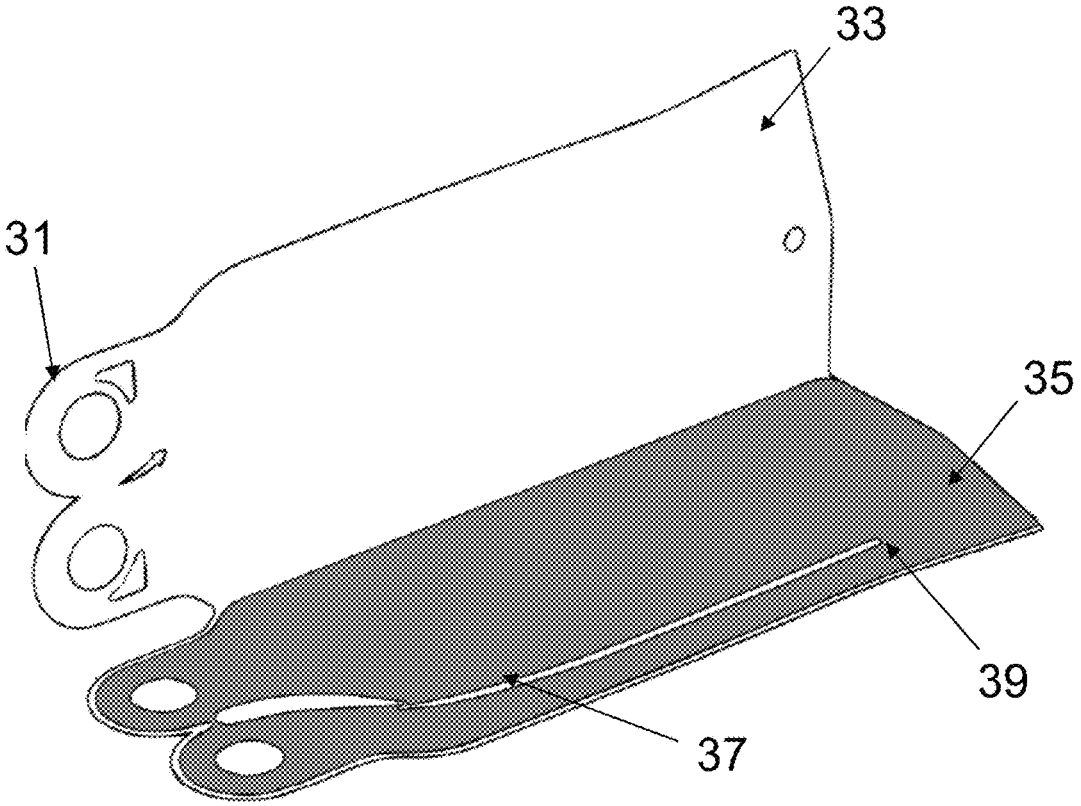
FIG. 7 is a schematic view showing the construction of the tearable container of an embodiment of the present invention.
Figure 8:
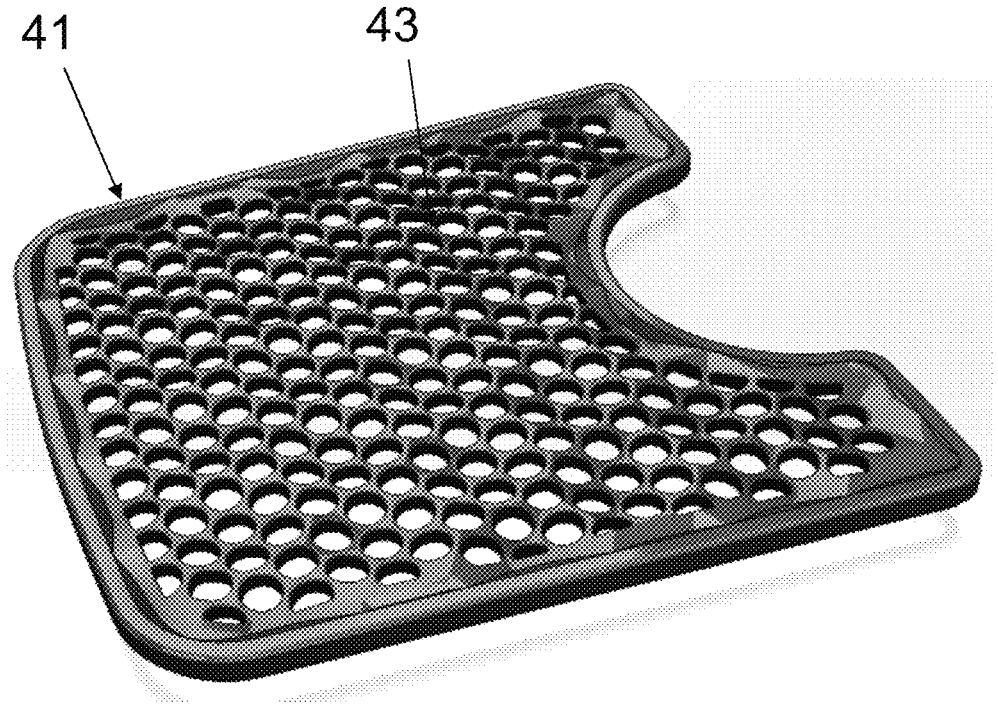
FIG. 8 shows a filter lid of an embodiment of the present invention.

As shown in FIG. 7, the vacuum bag 23 may be constructed from a first part 33, which for example may be a laminate of different layers of material. A second part 35 is laminated over a first portion of the first part 33. Then, a second portion of the first part 33 is folded over the second part 35 and joined to the second part 35 along seams (for example by heat welding) so as to form a vacuum bag 23.

Thus, a first main surface of the vacuum bag 23 comprises a laminate of the first part 33 and the second part 35. A second main surface of the vacuum bag 23 opposite to the first main surface comprises the first part 33.

The second part 35 has a greater resistance to tearing than the first part 33. In other words, it is more difficult for a person to tear the second part 35 than it is for the person to tear the first part 33. The second part 35 can therefore be considered to be a reinforcing layer that reinforces the first part 33 against tearing.

When the filtration mask 1 is packaged in the vacuum bag 23, the filtration mask 1 is located in the vacuum bag 23 with the front face of the filtration mask 1 comprising the filters 5 and the exhale module 7 adjacent to the second main surface of the vacuum bag 23.

As shown in FIG. 7, the second part 35 comprises a channel 37 (or a region) in which the second part 35 is omitted over the first part 33. The channel 37 extends in a line over the first part 33 from immediately below the handles 31 to an end point 39 proximal to a bottom end of the vacuum bag 23.

The channel 37 is elongate, and is sandwiched between regions of the second part 35 on the first part 33.

Since the tear resistant second part 35 is omitted in the channel 37, the vacuum bag 23 is much easier to tear along the channel 37 than through the laminate of the first part 33 and the second part 35. When a tear is started immediately beneath the handles, the tear therefore preferentially propagates along the channel 37, such that the channel 37 directs or guides the tear along the vacuum bag 23. The channel 37 starts immediately below the handles 31 so that the tear preferentially starts in the channel 37.

As such, the direction and extent of the tear of the vacuum bag 23 can be precisely controlled.

When the tear reaches the end point 39 of the channel 37, the resistance to tearing significantly increases due to the presence of the second part 35. Thus, an end point for the tear can clearly be felt by a person opening the vacuum bag 23, and further tearing of the vacuum bag 23 can be prevented.

As shown in FIGS. 6 and 7, the direction of the channel 37 is non-linear (the position of the channel 37 is indicated with a broken line in FIG. 6). Instead, the channel 37 curves around a corner of the vacuum bag 23 and then extends along, or adjacent to, a side of the vacuum bag 23.

The provision of the second part 35 and the channel 37 therefore allows precise control of the tearing of the vacuum bag 23 by a user, even when the user is in a hurry in an emergency situation. Reliable quick opening of the vacuum bag 23 by the user can therefore be ensured.

The position of the end point 39 of the channel 37 can be selected to prevent the filtration mask 1 from falling out of the vacuum bag 23 during opening, whilst providing sufficient access for the user to easily remove the filtration mask 1 from the vacuum bag 23. This can be achieved by carefully selecting a distance of the end point 39 from a bottom of the vacuum bag 23. In addition, or alternatively, the position of the start point of the channel 37 can be selected to prevent the filtration mask 1 from falling out of the vacuum bag 23 during opening, whilst providing sufficient access for the user to easily remove the filtration mask 1 from the vacuum bag 23. This can be achieved by positioning the start point of the channel 37 part way between the two sides of the vacuum bag 23, as shown in FIGS. 6 and 7. For example, the start point of the channel 37 may be positioned at a point between 25% and 75% of the distance between the two sides along a hypothetical perpendicular line between the two sides. Thus, when the container is torn along the channel 37, and the tear is directed towards one of the top corners of the container, the other top corner of the container may be left in place, so that the filtration mask is still partially supported by that top corner.

In a specific example, the first part 33 may be a laminate of the following materials: 15 micron oriented Polyamide/8 micron aluminium foil/15 micron oriented Polyamide/130 micron linear low density polyethylene.

The second part 35 may be made of high density polyethylene.

As shown in FIG. 1, for example, the filtration mask 1 includes filters 5.

The filters 5 include a filtration media for filtering ambient gas to produce filtered gas. For example, the filtration media may be activated carbon.

The filters 5 further include a filtration media support for supporting the filtration media. For example, the filtration media support may be an enclosure for enclosing the filtration media.

The filtration media support comprises a filter cover that covers the filtration media and compresses the filtration media. In particular, the filter cover needs to provide a necessary amount of compression force on the filtration media to maintain the filtration media in the correct position at the correct density.

In a conventional filtration mask, the filter cover has a flat, planar surface facing the filtration media for applying the compression force on the filtration media.

The present inventors have realised that in such an arrangement the resultant force acting on the filter cover due to the compression of the filtration media is perpendicular to the plane of the filter cover. This can result in bending and distortion of the filter cover, unless the filter cover is made from a significantly strong material such as metal, or has a significant thickness.

In an embodiment of the present invention, the filter cover instead has a non-planar surface facing the filter media.

Examples of a filter cover 41 according to an embodiment of the present invention are illustrated in FIGS. 8 to 11.

As shown in FIGS. 8 to 11, in an embodiment of the present invention the filter cover 41 has a non-planar surface 43 facing the filtration media.

In particular, the non-planar surface 43 comprises a plurality of different undulations/waves/vaults, such that the non-planar surface has an undulating/wavy/vaulted surface profile. This means that a height of the surface perpendicular to a plane of the filter cover varies over the surface of the filter cover.

The undulations/waves/vaults occur periodically with a fixed period over the surface.

As shown in FIGS. 8 to 11, there are a plurality of undulations/waves/vaults over the surface, for example more than two undulations/waves/vaults over the surface in any given direction.

Figure 9:
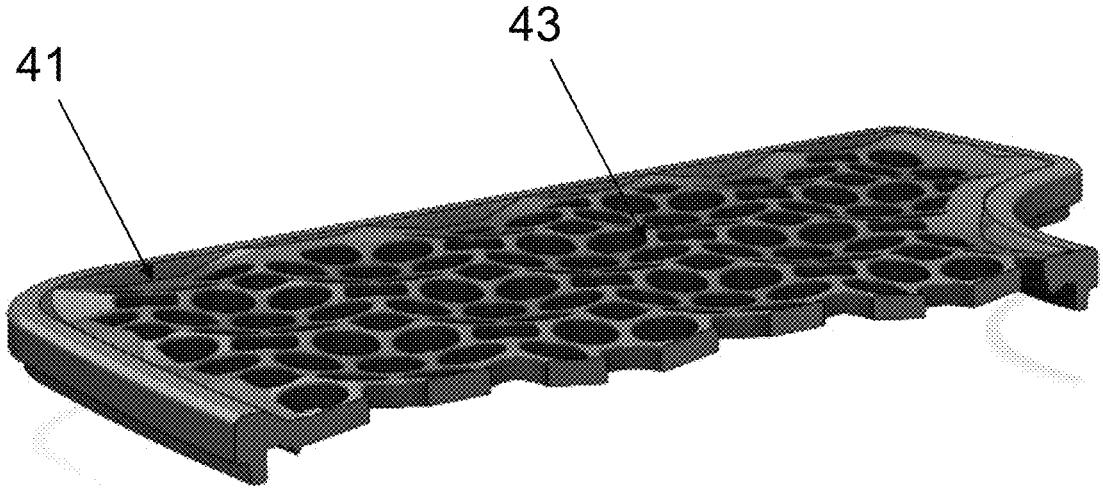
FIG. 9 is a cross-sectional view of the filter lid of FIG. 8.
Figure 10:
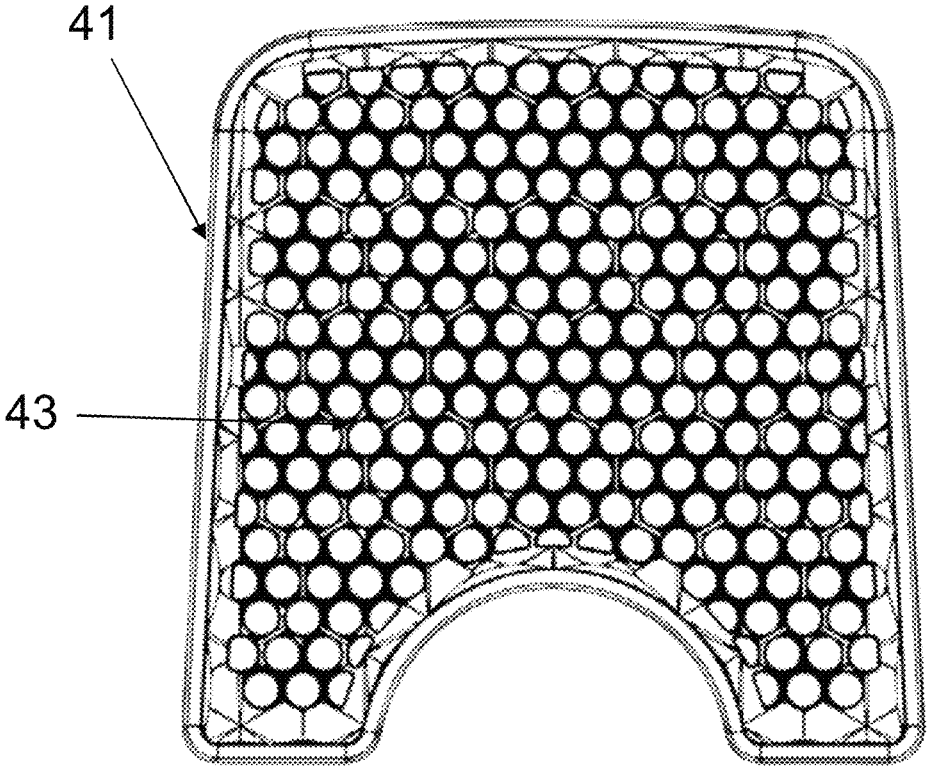
FIG. 10 is a schematic view illustrating a honeycomb pattern of holes in a filter lid of an embodiment the present invention.
Figure 11:
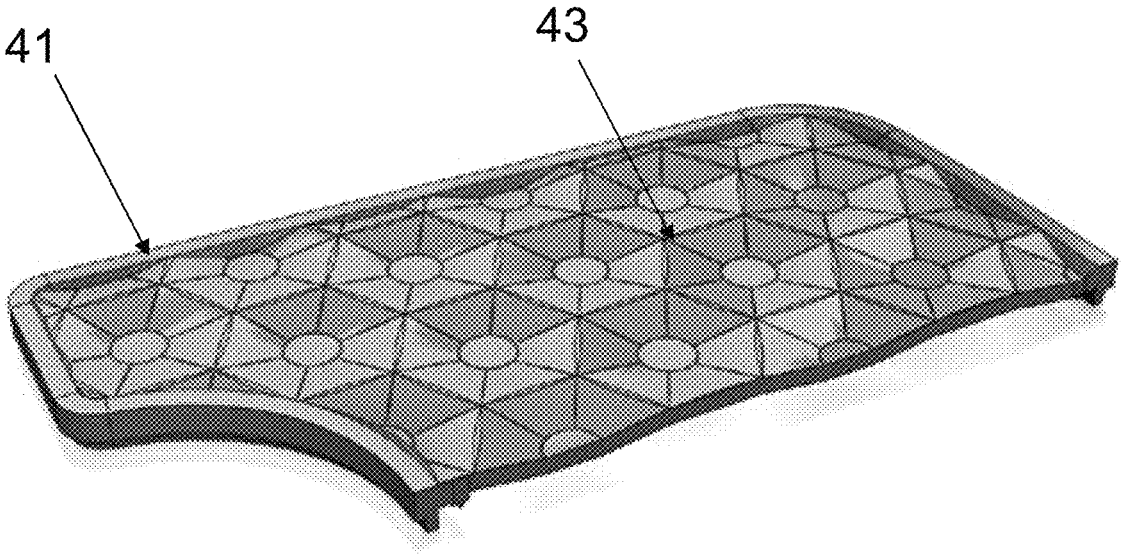
FIG. 11 is a schematic of a sectional view of the filter lid of FIG. 10 with the holes omitted to more clearly show the profile of the vaulted surface of the filter lid.

As shown in FIG. 9, in cross section the surface profile is an oscillating wave.

The undulating/wavy/vaulted surface of the filter cover 41 in embodiments of the present invention means that a direction of a normal force on the filter cover 41 from the compression of the filter media varies across the surface, because the direction of the surface normal varies across the surface due to the undulations/waves/vaults.

This means that the normal forces acting on the filter cover 41 are spread out and distributed over the filter cover 41, rather than merely acting directly perpendicular to the filter cover 41 as would be the case with a filter cover with a flat surface. This means that bending or deformation of the filter cover 41 can be reduced in embodiments of the present invention while still applying the necessary compression force on the filtration media.

This means that the filter cover 41 can be made of a weaker material such as plastic, for example injection moulded plastic, instead of metal. Such a material may be lighter and cheaper.

This also means that a thickness of the filter cover 41 can be reduced, for example to 2 mm or less, again reducing the cost and/or weight of material.

As shown in FIGS. 8 to 11, the filter cover 41 includes a plurality of holes, for allowing air to enter the filtration mask 1. The holes are arranged in a hexagonal honeycomb pattern.

Although individual embodiments have been discussed above, all, or any combination of, the above described embodiments can be combined in further embodiments of the present invention.

Numerous modifications to the above embodiments will be apparent to the skilled person without departing from the scope of the appended claims.

For example, in the first embodiment an indicator other than the tactile dome component can be used. For example, the indicator may have a different shape to a dome shape, and/or may move between two different positions instead of being compressed/depressed, and/or may be located in a different part of the filtration mask or container.

For example, in the second embodiment, the channel of the second part may have a different configuration. For example, the channel may comprise a portion where the thickness of the second part is reduced rather than omitting the second part, or where the resistance to tearing of the second part is otherwise reduced, for example by providing perforations in the second part. The tearable container may also or alternatively have a different configuration to the vacuum bag illustrated in FIGS. 6 and 7.

In the third embodiment, other shapes and/or configurations of non-planar surface can be used instead of the specific example of the non-planar surface illustrated in FIGS. 8 to 11.

Other aspects and/or embodiments of the present invention may be as specified in the following numbered clauses:

1. A packaged filtration mask comprising a filtration mask packaged in a container in a vacuum or a partial vacuum, wherein the packaged filtration mask comprises an indicator configured to indicate the presence of a vacuum or a partial vacuum in the container, or configured to indicate the lack of a vacuum or a partial vacuum in the container.

2. The packaged filtration mask according to clause 1, wherein the indicator is configured to adopt a first configuration when there is a vacuum or a partial vacuum in the container, and to adopt a second configuration when there is not a vacuum or a partial vacuum in the container.

3. The packaged filtration mask according to clause 2, wherein changing between the first configuration and the second configuration comprises deformation or movement of the indicator.

4. The packaged filtration mask according to clause 2 or clause 3, wherein:

changing from the second configuration to the first configuration comprises compression of the indicator; and changing from the first configuration to the second configuration comprises expansion of the indicator.

5. The packaged filtration mask according to any one of clauses 2 to 4, wherein the indicator is changeable from the second configuration to the first configuration by the application of a force to the indicator.

6. The packaged filtration mask according to clause 5, wherein the container is a flexible container, and wherein when there is a vacuum or a partial vacuum in the flexible container, the flexible container is configured to apply a force to the indicator to change the indicator from the second configuration to the first configuration.

7. The packaged filtration mask according to clause 5 or clause 6, wherein the indicator is configured to change back from the first configuration to the second configuration when the force is not applied to the indicator.

8. The packaged filtration mask according to any one of clauses 5 to 7, wherein a force greater than a predetermined threshold needs to be applied to the indicator to change the indicator from the second configuration to the first configuration.

9. The packaged filtration mask according to any one of clauses 5 to 8, wherein the indicator is changeable from the second configuration to the first configuration when there is not a vacuum or a partial vacuum in the container by applying a force to the indicator through the container.

10. The packaged filtration mask according to any one of clauses 5 to 9, wherein:

the packaged filtration mask comprises a second container in which the container is contained; and the indicator is changeable from the second configuration to the first configuration when there is not a vacuum or a partial vacuum in the container by applying a force to the indicator through the second container and the first container.

11. The packaged filtration mask according to any one of clauses 2 to 10, wherein the indicator makes a noise when changing from the second configuration to the first configuration.

12. The packaged filtration mask according to any one of the previous clauses, wherein:

the indicator comprises a dome switch that is resiliently compressible from a dome shape to a compressed dome shape by application of a force to the dome switch.

13. The packaged filtration mask according to clause 12, wherein:

the dome switch is configured to adopt the dome shape when there is not a vacuum or a partial vacuum in the container; and the dome switch is configured to adopt the compressed dome shape when there is a vacuum or a partial vacuum in the container.

14. The packaged filtration mask according to any one of the previous clauses, wherein the indicator is part of the filtration mask.

15. The packaged filtration mask according to any one of the previous clauses, wherein the indicator is positioned on an outer surface of the filtration mask.

16. The packaged filtration mask according to any one of the previous clauses, wherein the indicator is positioned on top of an exhale module of the filtration mask.

17. The packaged filtration mask according to any one of the previous clauses, wherein the indicator is on a front face of the filtration mask in the centre of a filter portion of the filtration mask.

18. The packaged filtration mask according to any one of the previous clauses, wherein part of a surface of the container is in contact with the indicator and moves or deforms when the indicator changes between the first state and the second state.

19. The packaged filtration mask according to clause 18, wherein the part of the surface of the container in contact with the indicator is discernible, marked or indicated on the container.

20. The packaged filtration mask according to any one of the previous clauses, wherein the container is a tearable container, and wherein:

at least a portion of the tearable container comprises a laminate of a first part and a second part;

a resistance to tearing of the second part is greater than a resistance to tearing of the first part; and the second part includes a channel portion for directing a tear along the laminate.

21. A filtration mask comprising an indicator that is configured to adopt a first configuration when the filtration mask is packaged in a container and there is a vacuum or a partial vacuum in the container, and to adopt a second configuration when the filtration mask is packaged in a container and there is not a vacuum or a partial vacuum in the container.

22. A tearable container, wherein:

at least a portion of the tearable container comprises a laminate of a first part and a second part;

a resistance to tearing of the second part is greater than a resistance to tearing of the first part; and the second part includes a channel portion for directing a tear along the laminate.

23. The tearable container according to clause 22, wherein the second part is omitted, or has a reduced resistance to tearing, in the channel portion.

24. The tearable container according to clause 22 or clause 23, wherein there is a filtration mask packaged in the tearable container.

25. The tearable container according to any one of clauses 22 to 24, wherein the first part is a laminate of a plurality of layers.

26. The tearable container according to any one of clauses 22 to 25, wherein the second part is a single layer.

27. The tearable container according to any one of clauses 22 to 26, wherein the channel portion extends along a curved line.

28. The tearable container according to any one of clauses 22 to 27, wherein the channel portion curves around a corner of the tearable container.

29. The tearable container according to any one of clauses 22 to 28, wherein the channel portion extends from a first position proximal to a top side of the container to a second position proximal to a bottom side of the tearable container.

30. The tearable container according to any one of clauses 22 to 29, wherein the channel portion extends along, or adjacent to, a side of the tearable container.

31. The tearable container according to any one of clauses 22 to 30, wherein the first part comprises a laminate of:

a first layer of oriented polyamide;

a second layer of aluminium foil;

a third layer of oriented polyamide; and a fourth layer of linear low-density polyethylene.

32. The tearable container according to any one of clauses 22 to 31, wherein the second part comprises a layer of high-density polyethylene.

33. The tearable container according to any one of clauses 22 to 32, wherein:

there is a filtration mask packaged in the tearable container; and the position and length of the channel portion are configured such that tearing the tearable container along the channel portion opens the tearable container such that the filtration mask can be removed from the container.

34. A blank for making a tearable container according to any one of clauses 22 to 33.

35. The packaged filtration mask according to any one of clauses 1 to 20 or the filtration mask according to clause 21, wherein the filtration mask comprises a filter, wherein the filter comprises:

a filtration media for filtering ambient gas to produce filtered gas; and a filtration media support for supporting the filtration media, wherein the filtration media support comprises a filter cover that covers the filtration media and compresses the filtration media;

wherein a main surface of the filter cover facing the filtration media is a non-planar surface.

36. A filtration mask comprising a filter, wherein the filter comprises:

a filtration media for filtering ambient gas to produce filtered gas; and a filtration media support for supporting the filtration media, wherein the filtration media support comprises a filter cover that covers the filtration media and compresses the filtration media;

wherein a main surface of the filter cover facing the filtration media is a non-planar surface.

37. The filtration mask according to clause 36, wherein the main surface of the filter cover is:

an undulating surface; or a vaulted surface; or a wavy surface; or a multi-faceted surface.

38. The filtration mask according to clause 37, wherein the undulation or vaulting or waves of the main surface of the filter cover have a fixed period.

39. The filtration mask according to any one of clauses 36 to 38, wherein the filter cover comprises holes arranged in a tessellation pattern.

40. The filtration mask according to any one of clauses 36 to 39, wherein the filter cover comprises holes arranged in a hexagonal honeycomb pattern.

41. The filtration mask according to any one of clauses 36 to 40, wherein the filter cover is made from plastic.

42. The filtration mask according to any one of clauses 36 to 41, wherein the filter cover has a thickness of 2 mm or less.

The invention claimed is:

1. A packaged filtration mask, comprising:

a filtration mask packaged in a container in a vacuum or a partial vacuum, the filtration mask having a front face and a filter portion positioned on the front face; and an indicator centrally located on the filter portion of the filtration mask, the indicator having a movable portion configured to move between a first position and a second position, with the first position defining a first configuration of the indicator and the second position defining a second configuration of the indicator, wherein the first configuration indicates the presence of a vacuum or a partial vacuum in the container, and wherein the second configuration indicates a lack of a vacuum or a partial vacuum in the container.

2. The packaged filtration mask according to claim 1, wherein movement between the first configuration and the second configuration comprises deformation of the movable portion of the indicator.

3. The packaged filtration mask according to claim 1, wherein:

movement from the second position to the first position comprises compression of the indicator; and movement from the first position to the second position comprises expansion of the indicator.

4. The packaged filtration mask according to claim 1, wherein the indicator is changeable from the second configuration to the first configuration by application of a force to the movable portion of the indicator.

5. The packaged filtration mask according to claim 4, wherein the container is a flexible container, and wherein when there is a vacuum or a partial vacuum in the flexible container, the flexible container is configured to apply a force to the movable portion of the indicator to change the indicator from the second configuration to the first configuration.

6. The packaged filtration mask according to claim 4, wherein the indicator is configured to change from the first configuration to the second configuration when the force is not applied to the indicator.

7. The packaged filtration mask according to claim 4, wherein the movable portion of the indicator is configured to move from the second position to the first position under application of a force greater than a predetermined threshold.

8. The packaged filtration mask according to claim 4, wherein the indicator is changeable from the second configuration to the first configuration when there is not a vacuum or a partial vacuum in the container by applying a force to the indicator through the container.

9. The packaged filtration mask according to claim 4, wherein:

the packaged filtration mask comprises a second container in which the container is contained; and the indicator is changeable from the second configuration to the first configuration when there is not a vacuum or a partial vacuum in the container by applying a force to the indicator through the second container and the container.

10. The packaged filtration mask according to claim 1, wherein the indicator makes a noise when changing from the second configuration to the first configuration.

11. The packaged filtration mask according to claim 1, wherein:

the indicator comprises a dome switch that is resiliently compressible from a dome shape to a compressed dome shape by application of a force to the dome switch.

12. The packaged filtration mask according to claim 11, wherein:

the dome switch is configured to adopt the dome shape when there is not a vacuum or a partial vacuum in the container; and the dome switch is configured to adopt the compressed dome shape when there is a vacuum or a partial vacuum in the container.

13. The packaged filtration mask according to claim 1, wherein the indicator is part of the filtration mask.

14. The packaged filtration mask according to claim 1, wherein the indicator is positioned on an outer surface of the filtration mask.

15. The packaged filtration mask according to claim 1, wherein the indicator is positioned on top of an exhale module of the filtration mask.

16. The packaged filtration mask according to claim 1, wherein part of a surface of the container is in contact with the indicator and moves or deforms when the indicator changes between the first configuration and the second configuration.

17. The packaged filtration mask according to claim 16, wherein the part of the surface of the container in contact with the indicator is discernible, marked or indicated on the container.

18. A packaged filtration mask, comprising:

a filtration mask packaged in a container in a vacuum or a partial vacuum; and an indicator forming part of the filtration mask, the indicator having a movable portion configured to move between a first position and a second position, with the first position defining a first configuration of the indicator and the second position defining a second configuration of the indicator, wherein the first configuration indicates the presence of a vacuum or a partial vacuum in the container, and wherein the second configuration indicates a lack of a vacuum or a partial vacuum in the container.

19. The packaged filtration mask according to claim 18, wherein the indicator is on a front face of the filtration mask in the centre of a filter portion of the filtration mask.

20. The packaged filtration mask of claim 18, wherein the container comprises a flexible container, and wherein the flexible container is configured to apply a force to the indicator to move the movable portion of the indicator from the second position to the first position when there is a vacuum or a partial vacuum in the flexible container.

* * * * *